US008538299B2

(12) United States Patent
Izawa et al.

(10) Patent No.: US 8,538,299 B2
(45) Date of Patent: Sep. 17, 2013

(54) WET TYPE DEVELOPING APPARATUS WITH PLURAL CLEANING BLADES

(75) Inventors: Hideo Izawa, Narashino (JP); Junichi Setoyama, Narashino (JP); Kotaro Harada, Narashino (JP)

(73) Assignee: Miyakoshi Printing Machinery Co., Ltd., Narushino-shi (JP)

( * ) Notice: Subject to any disclaimer, the term of this patent is extended or adjusted under 35 U.S.C. 154(b) by 253 days.

(21) Appl. No.: 13/100,626

(22) Filed: May 4, 2011

(65) Prior Publication Data

US 2011/0274466 A1 Nov. 10, 2011

(30) Foreign Application Priority Data

May 7, 2010 (JP) ..... 2010-107140

(51) Int. Cl.
*G03G 15/10* (2006.01)

(52) U.S. Cl.
USPC ..... 399/239; 399/240

(58) Field of Classification Search
USPC ..... 399/237, 239, 249, 240, 241
See application file for complete search history.

(56) References Cited

U.S. PATENT DOCUMENTS

| | | | | |
|---|---|---|---|---|
| 7,862,976 | B2 * | 1/2011 | Miura et al. | 399/237 |
| 8,023,847 | B2 * | 9/2011 | Toyama et al. | 399/239 |
| 8,391,757 | B2 * | 3/2013 | Mizushima et al. | |
| 2005/0271423 | A1 * | 12/2005 | Yamaguchi et al. | 399/237 |
| 2006/0222407 | A1 * | 10/2006 | Maseki | 399/249 |
| 2009/0196657 | A1 * | 8/2009 | Okumura et al. | 399/237 |
| 2010/0080595 | A1 * | 4/2010 | Sasaki et al. | 399/237 |
| 2010/0284709 | A1 * | 11/2010 | Izawa et al. | 399/249 |
| 2011/0249990 | A1 * | 10/2011 | Izawa et al. | 399/240 |

FOREIGN PATENT DOCUMENTS

| | | | |
|---|---|---|---|
| JP | 2007-171611 | A | 7/2007 |
| JP | 2007-225893 | A | 9/2007 |

* cited by examiner

*Primary Examiner* — Susan Lee
(74) *Attorney, Agent, or Firm* — Westerman, Hattori, Daniels & Adrian, LLP

(57) ABSTRACT

A wet type developing apparatus includes a set charger positioned opposite to a surface of the developing roller, a liquid developer applying device disposed at one of a position opposite to a surface of the developing roller and a position opposite to a surface of the cleaning roller, a first cleaning blade disposed in contact with a surface of the cleaning roller downstream of the area of rotational contact of the cleaning roller with the developing roller in the rotation direction of the cleaning roller, and a second cleaning blade disposed in contact with a surface of the developing roller downstream of the area of rotational contact of the cleaning roller with the developing roller in the rotation direction of the developing roller.

2 Claims, 1 Drawing Sheet

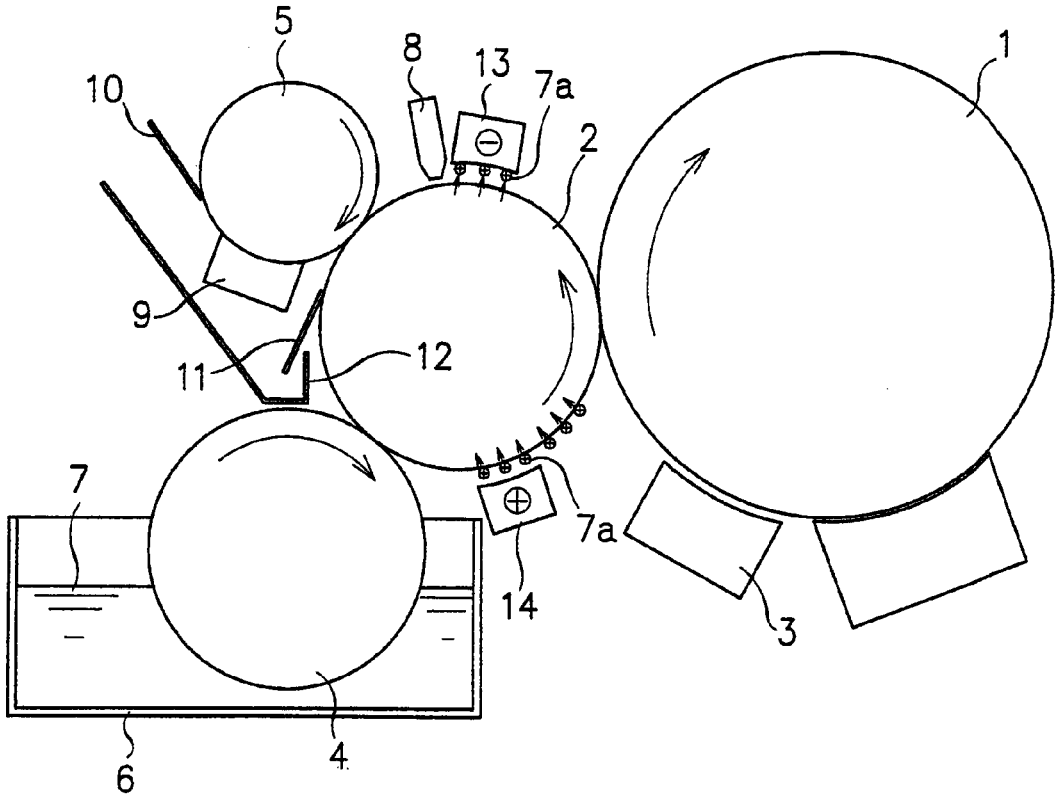
5
8
13
7a
1
10
2
9
11
12
7
7a
14
3
6
4

WET TYPE DEVELOPING APPARATUS WITH PLURAL CLEANING BLADES

TECHNICAL FIELD

The present invention relates to a wet type developing apparatus in which an electrostatic latent image formed on a surface of a photoconductor drum is developed into a toner image with a liquid developer fed onto a surface of a developing roller.

BACKGROUND ART

In wet type developing apparatus of this sort, a feed roller in part immersed in a liquid developer is driven to rotate in rotational contact with the developing roller so that the liquid developer is fed onto the developing roller via the feed roller, the developing roller being driven to rotate in rotational contact with the photoconductor drum (see JP 2007-171611 A). And, downstream from an area of rotational contact of the developing roller with the photoconductor drum in a rotation direction of the developing roller, there are disposed a cleaning roller and a cleaning blade for removing a residual liquid toner on the developing roller (see JP 2007-225893 A).

While a residual liquid toner that remains on the surface of the developing roller after the image is developed on the photoconductor drum is recovered into a toner recovery circuit by the cleaning roller and cleaning blade, it has been found that on the developing roller surface after development, such residual liquid toner, by having its carrier liquid component decreased and its density and viscosity raised, tends in nature to accumulate in the form of sludge and to coagulate thereon. As a result, a phenomenon called caking is caused that the coagulated toner adheres and sticks to the cleaning blade, creating streaks on the developing roller surface and thereby exerting an adverse influence on printing quality. Further, a problem also arises that the residual liquid toner made higher in density and viscosity causes piping for toner recovery in the toner recovery circuit to get clogged.

In view of the problems mentioned above, it is an object of the present invention to provide a wet type developing apparatus whereby the residual liquid toner from the developing roller can be well recovered, while avoiding occurrence of a caking phenomenon of residual liquid toner, or preventing the residual liquid toner from caking, at a periphery of a cleaning blade.

DISCLOSURE OF THE INVENTION

In order to achieve the object mentioned above, there is provided in accordance with the present invention a wet type developing apparatus including a developing roller driven to rotate in rotational contact with a photoconductor drum and a cleaning roller driven to rotate in rotational contact with the developing roller whereby an electrostatic latent image formed on a surface of the photoconductor drum is developed into a toner image with a liquid developer applied to a surface of the developing roller in rotational contact with the photoconductor drum, characterized in that the wet type developing apparatus comprises:

- a set charger positioned so as to be opposite to a surface of the developing roller downstream of an area of rotational contact of the developing roller with the photoconductor drum in a rotation direction of the developing roller for applying negative charge to the surface of the developing roller;
- a liquid developer applying means disposed at one of:
  - a position such that it is opposite to a surface of the developing roller between an area where the set charger is opposite to the developing roller and an area of rotational contact of the cleaning roller with the developing roller and
  - a position such that it is opposite to a surface of the cleaning roller downstream of the area of rotational contact of the cleaning roller with the developing roller in a rotation direction of the cleaning roller;
- a first cleaning blade disposed in contact with a surface of the cleaning roller downstream of the area of rotational contact of the cleaning roller with the developing roller in the rotation direction of the cleaning roller; and
- a second cleaning blade disposed in contact with a surface of the developing roller downstream of the area of rotational contact of the cleaning roller with the developing roller in the rotation direction of the developing roller.

In a wet type developing apparatus of the makeup mentioned above, there is preferably further provided a second set charger opposite to a surface of the developing roller upstream of the area of rotational contact of the developing roller with the photoconductor drum in the rotation direction of the developing roller for applying positive charge to the surface of the developing roller.

According to the present invention, applying negative charge from the set charger to a surface downstream of an area of rotational contact with the developing roller with the photoconductor drum in the rotation direction of the developing roller causes toner particles residual on a surface of the developing roller downstream of the area of its rotational contact with the photoconductor drum to be floated up by the negative charge of opposite polarity by the set charger from the surface of the developing roller, thereby making it possible for those toner particles to be largely recovered efficiently.

Also, applying a liquid developer to at least one of, a surface of the developing roller between the area where the set charger is opposite to the developing roller and the area of its rotational contact with the cleaning roller and a surface of the cleaning roller downstream of the area of its rotational contact with the developing roller in the rotation direction of the cleaning roller causes toner particles moving onto the cleaning roller to be spread by the liquid developer, thereby making it possible to prevent those particles from caking, or to avoid occurrence of a caking phenomenon, at a periphery of a cleaning blade.

Further, the residual liquid toner scraped off by the cleaning blade from the surfaces of the developing and cleaning rollers has its density reduced by being mixed with the liquid developer. The residual liquid toner scraped off can thus be prevented from clogging in the recovery piping. This facilitates bettering circularity of the residual liquid toner after its recovery in the toner recovery pipe conduit The above also makes it possible to achieve an improved cleaning effect even if the forces bringing the cleaning blades into contact with respective surface of the developing and cleaning rollers are weakened, while delaying the progression of surface wear of each roller by a respective cleaning blade. Thus, durability of each roller and a respective blade can be improved and quality of printing can be stabilized. In addition, the frequency of occurrence of a trouble in the circulating system of liquid toner after recovery is reduced and the apparatus can be worked stably over an extended period of time to improve its productivity.

Also, applying positive charge from the set charger to the surface of the developing roller upstream of the area of its rotational contact with the photoconductor drum in its rotary direction can positively charge the toner particles on the surface of the developing roller before an electrostatic latent image is thereby developed on the photoconductor drum, thus making it possible to better perform the developing action on the developing roller.

BRIEF DESCRIPTION OF THE DRAWING

FIG. 1 is an explanatory view diagrammatically illustrating a form of implementation of the present invention.

BEST MODES FOR CARRYING OUT THE INVENTION

Mention is made of a form of implementation of the present invention with reference to FIG. 1.

In the Figure, there are shown a photoconductor drum 1 and a developing roller 2 driven to rotate in rotational contact with the photoconductor drum 1 and by the developing roller an electrostatic latent image formed on a surface of the photoconductor drum 1 by exposure with an exposure unit 3 is developed into a toner image. An anilox roller (liquid developer feed roller) 4 is driven to rotate in rotational contact with the developing roller 2 for feeding a liquid developer onto the developing roller 2. A cleaning roller 5 is driven to rotate in rotational contact with the developing roller 2 for cleaning its surface. These are designed to be driven synchronously to rotate in their respective directions shown so that their peripheries move in an identical direction at their respective areas of rotational contact. The anilox roller 4 is in part immersed in liquid developer 7 within a toner tank 6. The liquid developer 7 in the toner tank 6 is supplied from a main tank (not shown) via a circuit (not shown).

A nozzle 8 is disposed at a position at which it is opposite to a surface of the developing roller 2 upstream of an area of rotational contact of the developing roller 2 with the cleaning roller 5 in the rotation direction of the developing roller 2. The nozzle 8 is connected with the main tank (not shown) from which liquid developer is applied by the nozzle 8 onto a surface of the developing roller 2.

Also, downstream of an area of rotational contact of the cleaning roller 5 with the developing roller 2 in a rotation direction of the cleaning roller 5, there is disposed a chamber 9 at a position such that its opening part is opposite to a surface of the cleaning roller 5 so as to be in sliding contact with the surface. The chamber 9 is supplied with liquid developer circulated via a circuit (not shown) from the main tank (not shown) and the liquid developer supplied into the chamber 9 is applied to a surface of the cleaning roller 5. And, a cleaning blade 10 is disposed in contact with a surface of the cleaning roller 5 downstream of the chamber 9 in the rotation direction of the cleaning roller 5 and downstream of the area of rotational contact of the cleaning roller 5 with the developing roller 2 in the rotation direction of the cleaning roller 5.

A cleaning blade 11 is disposed in contact with a surface of the developing roller 2 downstream of the area of rotational contact of the cleaning roller 5 with the developing roller 2 in the rotation direction of the developing roller 2. And, beneath the cleaning blade 11 and also under the cleaning blade 10 in contact with the cleaning roller 5, there is provided a toner catch pan 12 connected to a toner recovery circuit (not shown). The toner recovery circuit is in turn connected to the aforementioned main tank.

A set charger 13 for negative-charging is arranged so as to be opposite to a surface of the developing roller 2 upstream of the nozzle 8 in the rotation direction of the developing roller 2 for applying negative charge to the surface of the developing roller 2.

A set charger 14 for positive-charging is arranged so as to be opposite to a surface of the developing roller 2 upstream of the area of rotational contact of the developing roller 2 with the photoconductor drum 1 in the rotation direction of the developing roller 2 for applying positive charge to the surface of the developing roller 2.

In the makeup mentioned above, an electrostatic latent image formed on a surface of the photoconductor drum 1 is developed with the liquid developer fed onto the developing roller 2 from the anilox roller 4. And, liquid developer then on the surface of the developing roller 2 being charged positively by the set charger 14 for positive-charging upstream of the area of rotational contact of the developing roller 2 with the photoconductor drum 1 in the rotation direction of the developing roller 2, toner particles 7*a* in the liquid developer is flocculated towards the surface of the developing roller 2 whereby development of an electrostatic latent image on the photoconductor drum 1 with the developing roller 2 is performed very well.

As the developing roller 2 rotates in the direction of its rotation, negative charge is applied by the set charger 13 for negative-charging to a surface downstream of the area of its rotational contact with the photoconductor drum 1 in its rotation direction, then followed by application of the liquid developer to the surface from the nozzle 8.

Onto the surface of the developing roller 2 downstream of the area of its rotational contact with the photoconductor drum 1 in the direction of its rotation, a residual liquid toner as a residue of the liquid developer that has developed the electrostatic image on the photoconductor drum 1 is adhered in the state that it is reduced in carrier liquid component and densified, i. e., that toner particles are flocculated. As the developing roller 2 rotates, the toner particles 7*a* in the residual liquid toner having applied thereto negative charge by the set charger 13 for negative-charging come to have a negative potential that is opposite in polarity to the charge applied by the upstream set charger 14 and thus undergo a force by which they are apart from the surface of the developing roller 2.

The toner particles 7*a* in fresh liquid developer that is supplied from the nozzle 8 immediately downstream of the negative-charging position become floated up via the carrier liquid from the surface of the developing roller 2.

A large part of the toner particles 7*a* floated up is moved onto the cleaning roller 5 in rotational contact with the developing roller 2 downstream of the developer supplying position in the rotation direction of the developing roller, together with a part of the carrier liquid. And, a large part of the carrier liquid that remains on the developing roller 2 is scraped off by the cleaning blade 11 in contact with the developing roller 2 downstream of the area of its rotational contact with the cleaning roller 5 in the rotation direction of the developing roller and is accepted in the toner catch pan 12 disposed under the cleaning roller 5.

On the other hand, liquid developer in the chamber 9 is supplied from this chamber onto a surface of the cleaning roller 5 downstream of the area of its rotational contact with the developing roller 2 in the rotation direction of the cleaning roller, the cleaning roller 5 having the toner particles 7*a* adhered thereto from the developing roller 2.

The toner particles 7*a* that are moved from the developing roller 2 and flocculated on the cleaning roller 5 are thus restored by the liquid developer in the chamber 9 to a state that reduces their tendency to bring about caking (state of coagulation), near to the state that they are originally in the liquid developer. Thereafter, the toner particles 7*a* restored near to the state that they are originally in the liquid developer are scraped off, together with the liquid developer supplied from the chamber 9, by the cleaning blade 10 disposed downstream of the chamber 9 in the rotation direction of the cleaning roller 5, the particles and the liquid developer being then accepted by the toner catch pan 12. And, the toner particles recovered are returned together with the carrier liquid collected by the cleaning blade 11 at the side of the developing roller 2, into the main tank via a recovery path from the toner catch pan 12.

In the form of implementation mentioned above, the chamber 9 shown disposed downstream of the area of rotational contact of the cleaning roller 5 with the developing roller 2 in the rotation direction of the cleaning roller 5 may be replaced by a nozzle for feeding a surface of the cleaning roller 5 with the liquid developer.

As for the nozzle 8 for feeding the liquid developer onto a surface of the developing roller 2 upstream of the area of its rotational contact with the cleaning roller 5 in the rotation direction of the developing roller and the chamber 9 for feeding the liquid developer onto a surface of the cleaning roller 5 downstream of the area of its rotational contact with the developing roller 2 in the rotation direction of the cleaning roller, either one may be used except where both are used.

This is because with the nozzle 8 used alone to feed the liquid developer onto the surface of the developing roller 2 upstream of the area of its rotational contact with the cleaning roller 5 in the rotation direction of the developing roller, the residual liquid toner can be prevented from caking at a periphery of the cleaning blade 10 even if the liquid developer is not supplied onto a surface of the cleaning roller 5 downstream of the area of its rotational contact with the developing roller 2 in the rotation direction of the cleaning roller whereas with the chamber 9 used alone downstream of the area of the rotational contact of the cleaning roller 5 with the developing roller 2 in the rotation direction of the cleaning roller to thoroughly supply the liquid developer, caking may likewise be prevented even if the liquid developer is not supplied by the nozzle 8 disposed upstream of the area in the rotation direction of the developing roller 2.

Further, the caking preventive measure according to the present invention necessitates a set charger 13 for negative-charging disposed downstream of the area of rotational contact of the developing roller 2 with the photoconductor drum 1 in the rotation direction of the developing roller but not a set charger 14 for positive-charging disposed upstream of the area in the rotation direction of the developing roller if bias voltages are applied to the developing roller 2 and the photoconductor drum 1.

What is claimed is:

1. A wet type developing apparatus including a developing roller driven to rotate in rotational contact with a photoconductor drum and a cleaning roller driven to rotate in rotational contact with the developing roller whereby an electrostatic latent image formed on a surface of the photoconductor drum is developed into a toner image with a liquid developer applied to a surface of the developing roller in rotational contact with the photoconductor drum, characterized in that the wet type developing apparatus comprises:

a set charger positioned so as to be opposite to a surface of the developing roller downstream of an area of rotational contact of the developing roller with the photoconductor drum in a rotation direction of the developing roller for applying negative charge to the surface of the developing roller;

a liquid developer applying means disposed at one of:

a position such that it is opposite to a surface of the developing roller between an area where the set charger is opposite to the developing roller and an area of rotational contact of the cleaning roller with the developing roller and a position such that it is opposite to a surface of the cleaning roller downstream of the area of rotational contact of the cleaning roller with the developing roller in a rotation direction of the cleaning roller;

a first cleaning blade disposed in contact with a surface of the cleaning roller downstream of the area of rotational contact of the cleaning roller with the developing roller in the rotation direction of the cleaning roller; and a second cleaning blade disposed in contact with a surface of the developing roller downstream of the area of rotational contact of the cleaning roller with the developing roller in the rotation direction of the developing roller.

2. A wet type developing apparatus as set forth in claim 1, characterized in that it further comprises a set charger opposite to a surface of the developing roller upstream of the area of rotational contact of the developing roller with the photoconductor drum in the rotation direction of the developing roller for applying positive charge to the surface of the developing roller.

* * * * *